US007128003B2

(12) United States Patent
Okninski

(10) Patent No.: US 7,128,003 B2
(45) Date of Patent: Oct. 31, 2006

(54) LIFTING DEVICE FOR VISUAL SCREENS

(76) Inventor: Marek Okninski, 6148 Woodbine St., Apt 3R, Flushing, NY (US) 11385

( * ) Notice: Subject to any disclaimer, the term of this patent is extended or adjusted under 35 U.S.C. 154(b) by 294 days.

(21) Appl. No.: 10/428,674

(22) Filed: May 5, 2003

(65) Prior Publication Data

US 2004/0221775 A1 Nov. 11, 2004

(51) Int. Cl.
*A47B 9/00* (2006.01)

(52) U.S. Cl. ..... 108/147

(58) Field of Classification Search ..... 108/147, 108/144.11, 147.11, 147.15, 147.19, 106; 248/404, 405, 188.2, 188.4, 188.5
See application file for complete search history.

(56) References Cited

U.S. PATENT DOCUMENTS 3,361,510 A * 1/1968 McDermott ..... 108/147
3,415,586 A * 12/1968 Hammond ..... 108/147
3,467,971 A * 9/1969 Wieland ..... 108/147
3,908,565 A * 9/1975 Burnett ..... 108/147
4,134,689 A * 1/1979 Ahrenskou-Sorensen ... 108/147
4,635,565 A * 1/1987 Novak ..... 108/147
4,651,652 A * 3/1987 Wyckoff ..... 108/147
4,752,102 A * 6/1988 Rasmussen ..... 108/147
5,088,421 A * 2/1992 Beckstead ..... 108/147
5,129,611 A * 7/1992 Grover et al. ..... 108/147
6,152,049 A * 11/2000 Schmidt ..... 108/147
6,494,150 B1 * 12/2002 Phoenix et al. ..... 108/147
6,902,243 B1 6/2005 Bober

FOREIGN PATENT DOCUMENTS

DE 4023768 A1 * 1/1992

* cited by examiner

*Primary Examiner*—Jose V. Chen
(74) *Attorney, Agent, or Firm*—Sughrue Mion, PLLC

(57) ABSTRACT

A device for lifting and lowering visual displays, such as television sets, video monitors, plasma displays, pieces of art, or the like. The elevating device includes an elevating mechanism that elevates a first sliding frame and a second sliding frame. The first and second sliding frames move independently inside of a mounting frame. A motor rotates a pair of vertical threaded rods to drive the first sliding frame and cause the first sliding frame to rise and fall. A belt and pulley configuration transfers an elevating force from the first sliding frame to the second sliding frame. The second sliding frame includes supporting bars and is elevated to place the display at a desired height and is retracted to conceal the display in a cabinet, or the like.

10 Claims, 4 Drawing Sheets

LIFTING DEVICE FOR VISUAL SCREENS

BACKGROUND OF THE INVENTION

1. Field of the Invention

The present invention relates to a device for lifting and lowering visual displays, such as television sets, video monitors, art pieces, flat plasma displays and the like.

2. Background of the Invention

The development of television technology has been very progressive, with television sets becoming very large and thin. The most recent aspect of this technology is thin, flat plasma TV displays. Since it is preferable to hide a display when not in use, there is a need for a lifting device, which would enclose a plasma display within any type of cabinet, and elevate the display above such cabinet. Existing devices are esthetically unsightly or impractical. For example, U.S. Pat. No. 6,494,150 provides a lift having a very heavy construction and does not provide a way of mounting the lift along its height. Since prior art lifts can only be attached at their base, they lack vertical stability and therefore are unlikely to be used successfully as a lift for a Plasma TV. Accordingly, a lift device is needed, which is compact, light, efficient, stable and safe.

BRIEF SUMMARY OF THE INVENTION

An aspect of the invention is to provide a simple, practical and safe design, which can work with different types and sizes of plasma displays. An embodiment of the present invention includes a sliding frame within a frame construction, where two frames slide independently inside or outside a third fixed frame.

An illustrative embodiment of the invention is designed to be light and compact. For example, it is possible to make the lift as thin as 1¾" for lower weight visual displays and 2¼" thick for heavy weight visual displays. A plasma TV or visual display may be mounted to the lift by two horizontally placed display-supporting bars. A mounting height of the bars may be adjustable. In an exemplary embodiment, the lifting device itself is mounted along its full height, to a back panel (e.g., ¾" Veneer Core Plywood), which replaces an original furniture back. This is done because in many cases, the back of the furniture is made out of ¼" thick MDF or Flake Board, for example, which doesn't provide enough stability to support the weight of a lift and the display. A further aspect of the invention is an achievement of horizontal and vertical stability, which is lacking in the prior art. In an embodiment, the stability is achieved by mounting the lift directly to a vertical surface along its full height.

The present invention is also highly efficient. In an exemplary embodiment, a small dimensioned 24VDC right angle gear motor is used, which is hidden inside the lift's enclosure. High efficiency is further achieved with the use of ball bearing slides and Teflon based lead screw nuts. Lifting action is provided, for example, with a combination of ¾" lead screws, chains or belts and pulleys or roller chain sprockets.

According to an exemplary embodiment, all working parts are fully housed inside the lift's enclosure and not accessible by user. It is further contemplated that the lift doesn't have any horizontally placed parts, which could create a cutting action. These features dramatically decrease the chance of injury by a user or child, while the lift is in action, making the present invention a much safer construction than prior lifts, which did not offer a way of enclosing all working parts.

DETAILED DESCRIPTION OF EXEMPLARY EMBODIMENTS

Figure 1:
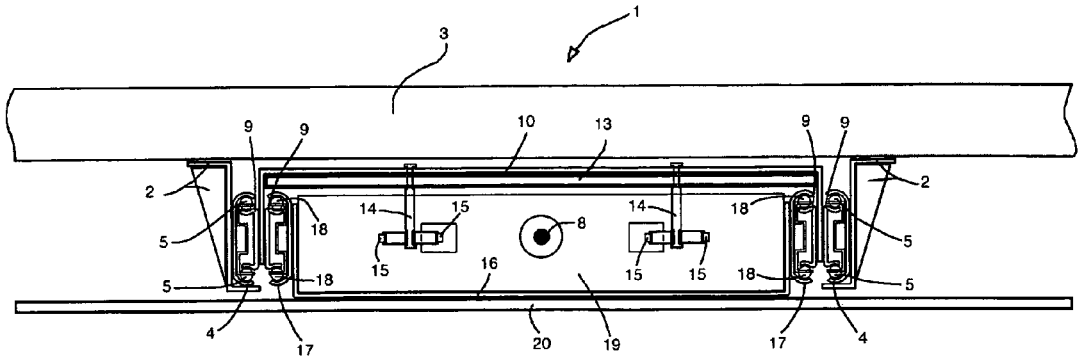
FIG. 1 is top view of a single screw exemplary embodiment.
Figure 2:
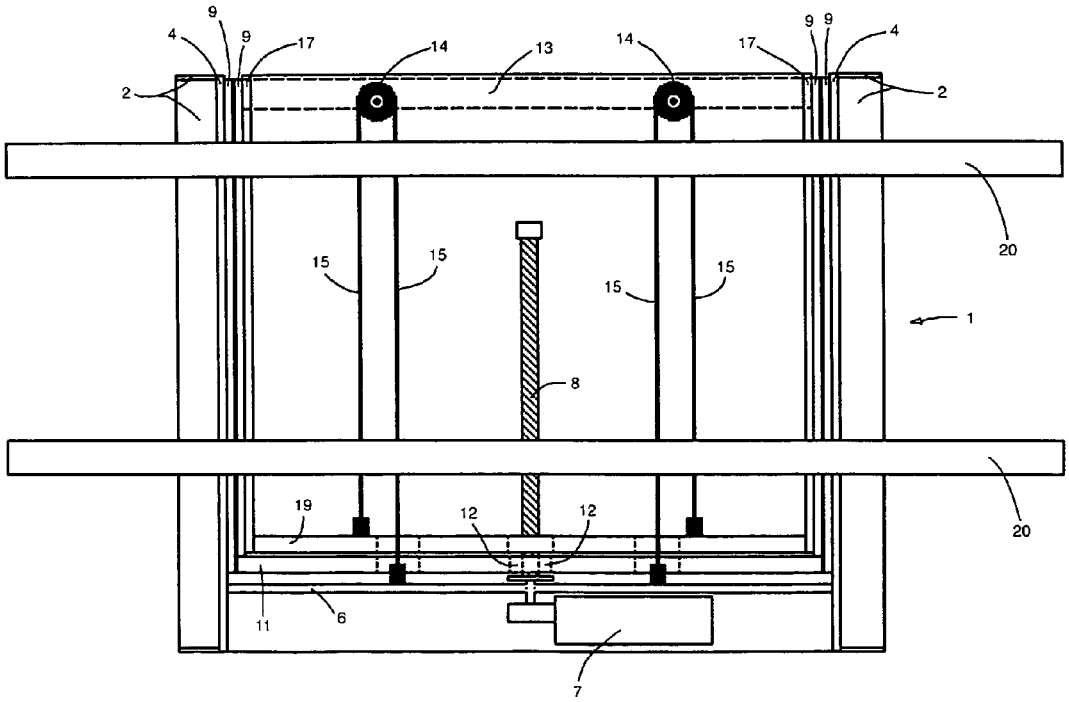
FIG. 2 is a front view of an exemplary embodiment in a lowered position.
Figure 3:
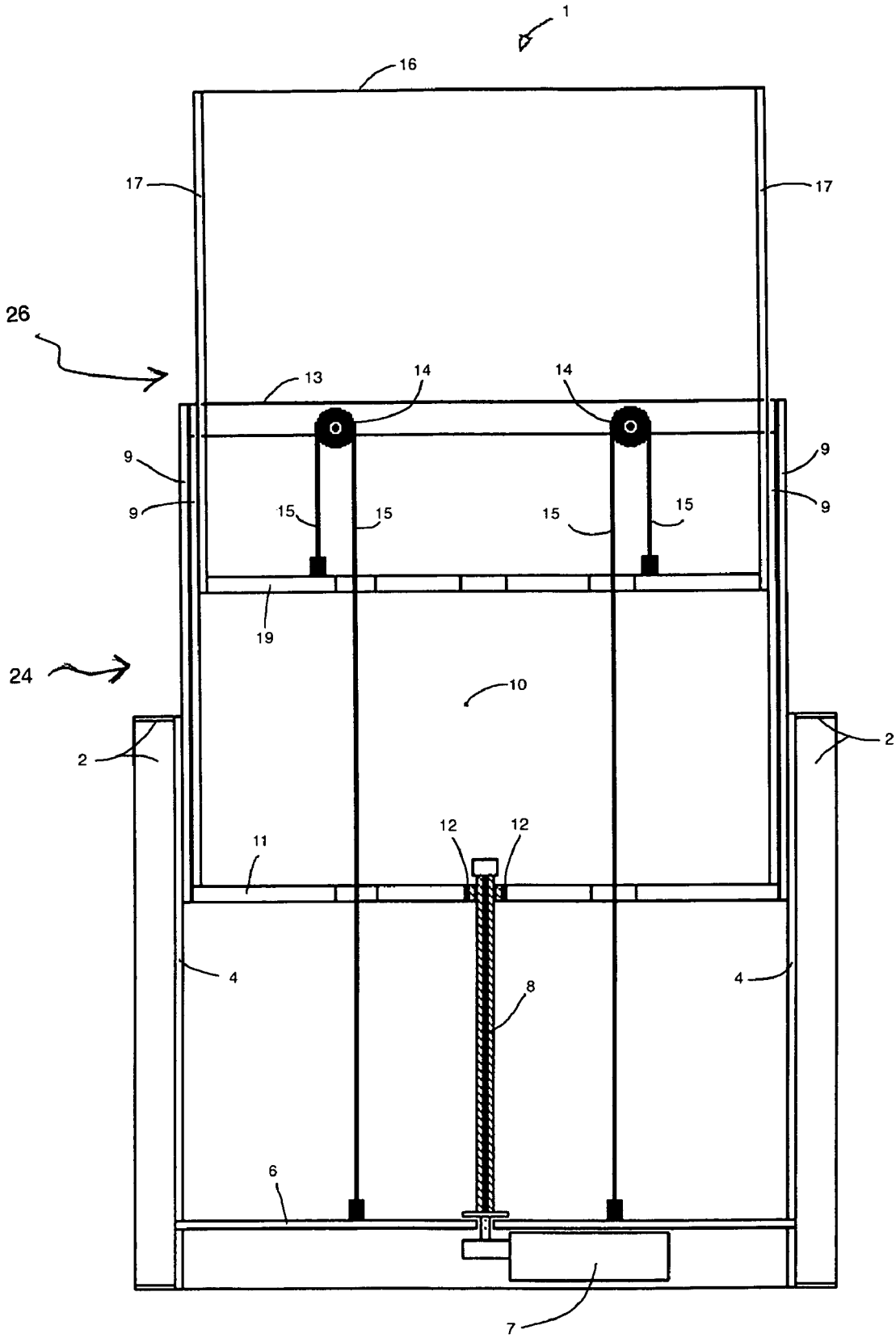
FIG. 3 is front view of an embodiment in an elevated position.

Referring now to the FIGS. 1–3, an elevating apparatus 1 is shown having a pair of lift-mounting brackets 2 mounted to a mounting panel 3, and a pair of outer slide members 4 attached to the lift-mounting brackets 2. A horizontal motor-mount bar 6 is attached to the lift-mounting brackets 2, and a single shaft right angle gear motor 7 is mounted to the motor-mount bar 6. A single vertical threaded rod 8 is mounted to a shaft of gear motor 7. Two pairs of inner slide members 9 are attached to a back panel 10. Ball bearings 5 are disposed between the inner slide members 9 and the lift-mounting brackets 2. A horizontal bar 11 is attached to the back panel 10. A single threaded nut 12 is mounted on the vertical threaded rod 8 and attached to the horizontal bar 11. A sprockets/pulleys-bar 13 is attached to the back panel 10. A pair of sprockets/pulleys 14 are attached to the sprockets/pulleys-bar 13 of the back panel 10. A pair of chains/belts 15 are mounted on the sprockets/pulleys 14 where each is attached to the motor-mount bar 6 at one end and to a horizontal bar 19, attached to the front panel 16 at the other end. A pair of outer slide members 17 is attached to the front panel 16 and ride on ball bearings 18. Two display-supporting bars 20 are mounted to the front panel 16.

In operation, the single shaft gear motor 7 rotates the vertical threaded rod 8. The single threaded nut 12 on the rod 8 is attached to a sliding inner frame 24. The sliding inner frame 24 comprises the back panel 10, the four inner slide members 9, the horizontal bar 11, the sprockets/pulleys-bar 13 and the threaded nut 12. The threaded nut 12 is mounted on the threaded rod 8 and attached to the horizontal bar 11. Rotation of the threaded rod 8 causes the threaded nut 12 and sliding inner frame 24 to rise and fall under control of the motor 7.

An exemplary additional lifting mechanism is provided that includes the two sprockets/pulleys 14 and the two chains/belts 15, which causes a sliding outer frame 26 with the display-supporting bars 20 to elevate or lower to a height above the height of the retracted apparatus for concealment in shorter cabinet. The front panel 16, two outer slide members 17 and the horizontal bar 19 constitute the sliding outer frame 26.

Figure 4:
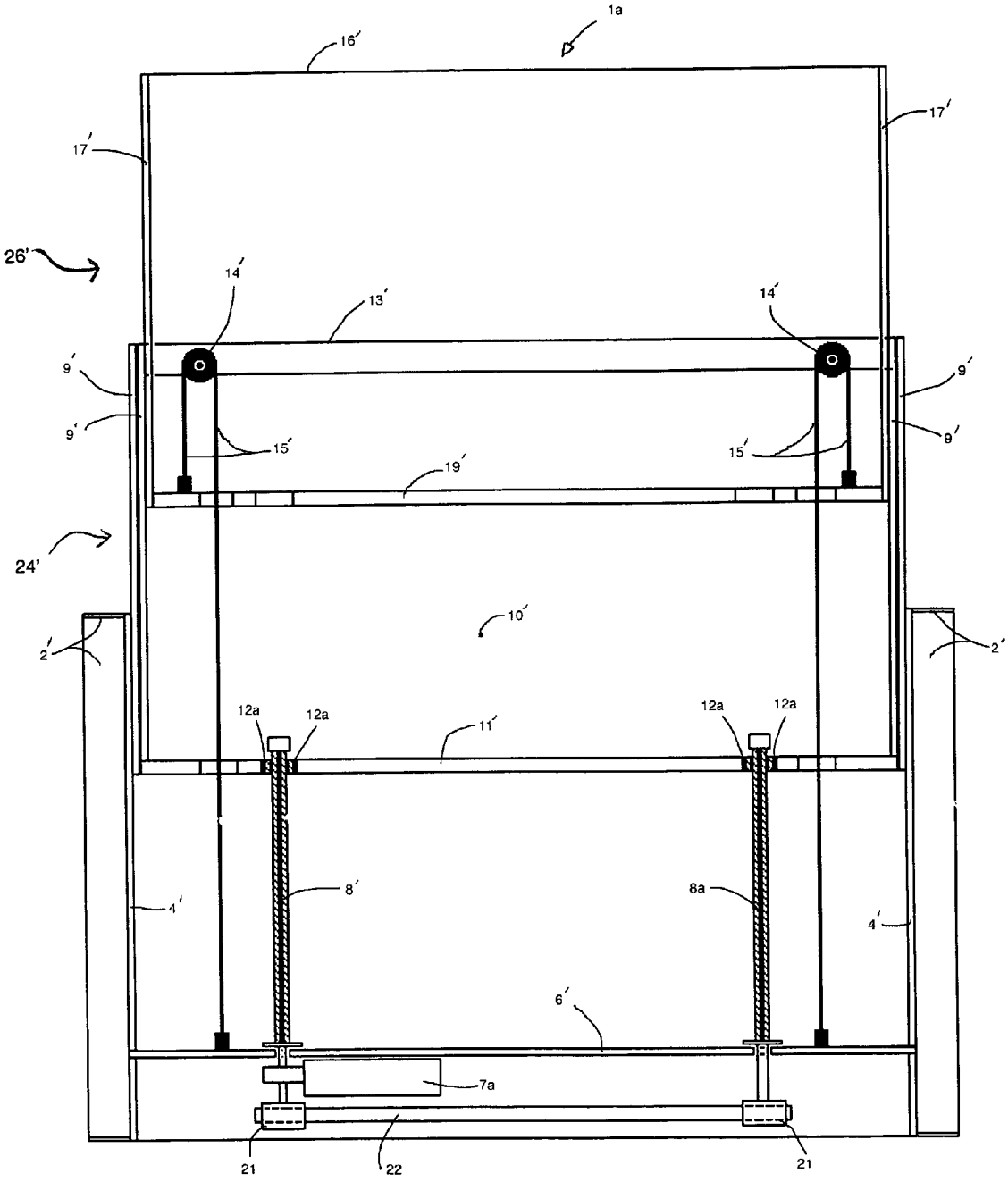
FIG. 4 is front view of an exemplary embodiment in an elevated condition.

As shown in FIG. 4 an exemplary embodiment further provides for a pair of lift-mounting brackets 2' to be mounted to a mounting panel 3 (FIG. 1), and a pair of outer slide members 4' to be attached to the lift mounting brackets 2'. Ball bearings having the same structure as the ball bearings 5 in FIG. 1 are disposed between the inner slide members 9' and the lift-mounting brackets 2'. A horizontal motor-mount bar 6' is attached to the lift-mounting brackets 2', and a double shaft-right angle gear motor 7*a* is mounted to the motor-mount bar 6'. A vertical threaded rod 8' is mounted to one end of the double shaft gear motor 7*a*, and the vertical threaded rod 8*a* is mounted inside the motor-mount bar 6'. Two pairs of inner slide members 9' are attached to a back panel 10'. A horizontal bar 11' is also attached to the back panel 10'. A pair of threaded nuts 12*a* are mounted on the vertical threaded rods 8', 8*a* and are attached to the horizontal bar 11'. A sprockets/pulleys-bar 13' is attached to the back panel 10', and a pair of sprockets/pulleys 14' are attached to sprockets/pulleys-bar 13'. A pair of chains/belts 15' are mounted on the sprockets/pulleys 14' and each is attached to the motor-mount bar 6' at one end and to a horizontal bar 19' at the other end. A pair of outer slide members 17' is attached to the front panel 16' and ride on ball bearings having the same structure as the bearings 18 in FIG. 1. A pair of display-supporting bars 20 (FIG. 2) are to be mounted to the front panel 16'. A pair of sprockets 21 are provide such that one is attached to the shaft of double shaft motor 7*a* and other is attached to vertical threaded rod 8*a*. A chain 22 connects the pair of sprockets 21.

In operation, the double shaft gear motor 7*a* rotates the pair of vertical threaded rods 8', 8*a* at the same rate through the set of sprockets 21 and the connecting chain 22. A first sprocket is attached to one end of double shaft gear motor 7*a*, and a second sprocket is attached directly to the second threaded rod 8*a*. The two sprockets are connected with the chain 22 to rotate rods in synchrony. The two threaded nuts 12*a* on the rods 8',8*a*, are attached to a sliding inner frame 24'. The sliding inner frame 24' comprises the back panel 10', four inner slide members 9', the horizontal bar 11', the sprockets/pulleys-bar 13' and the two threaded nuts 12*a*. The threaded nuts 12*a* are mounted on the threaded rods 8', 8*a* and are attached to the horizontal bar 11'. Synchronous rotation of the threaded rods 8', 8*a* causes the threaded nuts 12*a* and the sliding inner frame 24' to rise and fall under control of the motor 7*a*.

An exemplary additional lifting mechanism is provided that includes the two sprockets/pulleys 14' and the two chains/belts 15' and causes a sliding outer frame 26' with the display-supporting bars 20 (FIG. 2) to elevate or lower to a height above the height of the retracted apparatus for concealment in shorter cabinet. The sliding outer frame 26' comprises the front panel 16', the two outer slide members 17' and the horizontal bar 19'.

Figure 5:
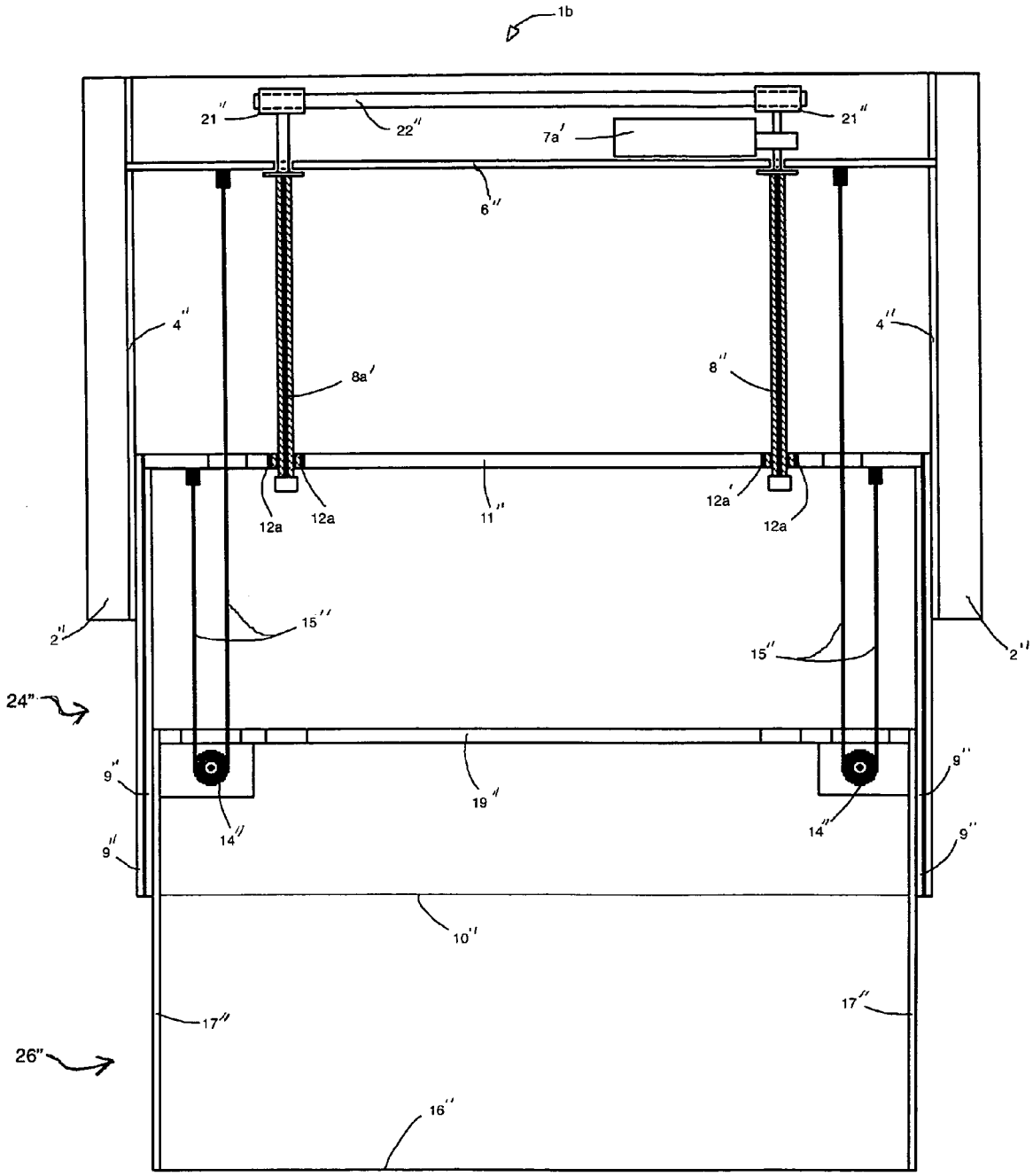
FIG. 5 is front view of an exemplary embodiment in a lowered condition.

A further exemplary embodiment is shown in FIG. 5 that includes an elevating apparatus 1*b*. A pair of lift-mounting brackets 2" are mounted to a mounting panel 3 (FIG. 1), and a pair of outer slide members 4" are attached to lift mounting brackets 2". Ball bearings are provided in the same manner as shown in FIG. 1. A horizontal motor-mount bar 6" is attached to the lift-mounting brackets 2" and a double shaft-right angle gear motor 7*a'* is mounted to the motor-mount bar 6". A vertical threaded rod 8" is mounted to one end of the double shaft gear motor 7*a'*. A vertical threaded rod 8*a'* is mounted inside the motor-mount bar 6". Two pairs of slide members 9" are attached to a back panel 10" and a horizontal bar 11" is also attached to the back panel 10". A pair of threaded nuts 12*a'* are mounted on the threaded rods 8", 8*a'* and attached to the horizontal bar 11". A pair of sprockets/pulleys 14" are attached to the front panel 16" and a pair of chains/belts 15" are mounted on the sprockets/pulleys 14" such that the pair of chains/belts 15" are respectively attached to the motor-mount bar 6" at one end and to the horizontal bar 11" at the other end. A pair of outer slide members 17" are attached to the front panel 16" and ride on ball bearings, as in FIG. 1. A pair of display-supporting bars 20 (FIG. 2) are to be mounted to the front panel 16". A pair of sprockets 21" are provided such that one sprocket is attached to a shaft of the double shaft motor 7*a'* and the other is attached to the vertical threaded rod 8*a'*. A chain 22" connects the pair of sprockets 21".

In operation, the double shaft gear motor 7*a'* rotates the pair of threaded rods 8", 8*a'* at the same rate through the set of sprockets 21" and the connecting chain 22". The first sprocket is attached to one end of the double shaft gear motor 7*a*, and the second sprocket is attached directly to the second threaded rod 8*a'*. The two sprockets 21" are connected with the chain 22" to rotate the rods 8", 8*a'* in synchrony. The two threaded nuts 12*a'* on the rods 8",8*a'* are attached to a sliding inner frame 24". The sliding inner frame 24" comprises the back panel 10", the four inner slide members 9", the horizontal bar 11" and the two threaded nuts 12*a'*. The threaded nuts 12*a'* are mounted on the threaded the rods 8", 8*a'* and are attached to the horizontal bar 11". Synchronous rotation of the threaded rods 8",8*a'* causes threaded nuts 12*a'* and the sliding inner frame 24" construction to rise and fall under control of the motor 7*a'*.

An additional lifting mechanism comprising the two sprockets/pulleys 14" and the two chains/belts 15" cause a sliding outer frame 26" with the display-supporting bars 20, to elevate to a desired height or retract for concealment in a shorter cabinet. The sliding outer frame 26" comprises the front panel 16", the two outer slide members 17" and horizontal bar 19".

An aspect of the invention is a three-frame system including a frame-within-a-frame design, where two frames slide independently inside of a third one. Moreover, for vertical guides, a combination of ball bearing slides with an open track is used. The frame-within-a-frame construction that uses the open truck slides provides a means to allow an over-extending lift to be attached along its full height.

An exemplary embodiment employs standard industrial, rolled coil steel, and a ball bearing slide, in an open truck design. However, it will be understood that any type of slide or vertical guide with an open track design, which provides ability for a frame-within-frame-construction, could be used. The arrangement or the description of the frames or slides may be changed. Therefore, it will be understood that the invention may be embodied otherwise than as herein specifically illustrated or described and that certain changes in form and arrangement of parts and the specific manner of practicing the invention may be made within the underlying idea or principles of the invention.

In addition, if the lift is used in pairs with a platform attached in between, it could lower large dimensional objects, such as video projectors and regular TV sets.

What is claimed is:

1. An elevating apparatus for a visual display comprising:

a mounting frame;

a first movable frame slidably engaged to said mounting frame;

a second movable frame to support a display, the second movable frame being slidably engaged to said first movable frame;

a threaded rod which engages the first movable frame so as to raise and lower the first movable frame, the threaded rod being disposed at a midsection of the first movable frame in a widthwise direction of the first movable frame; and at least one pulley attached to the first movable frame and at least one pliable member which engages the at least one pulley, wherein one side of the pliable member is coupled to the mounting frame and another side of the pliable member is coupled with the second movable frame, such that the second movable frame moves at a greater rate than the first movable frame due to a mechanical advantage provided by the at least one pulley, wherein the first movable frame and the second movable frame are disposed in relation to each other in one of a retracted configuration and an extended configuration, and wherein at least a portion of the second movable frame extends vertically past the first movable frame in the extended configuration.

2. The elevating apparatus of claim 1, wherein the threaded rod is positioned behind a backside of the visual display when the elevating apparatus is in the retracted position, such that a portion of the threaded rod is disposed at a height equal to a height of a portion of the visual display in a horizontal plane.

3. The elevating apparatus of claim 1, wherein the movable frame configuration includes a mount bar with an internally threaded portion, the threaded rod being engaged with the internally threaded portion.

4. The elevating apparatus of claim 1, wherein at least a portion of the movable frame configuration includes a panel.

5. The elevating apparatus of claim 1, wherein ball bearings are provided between the movable frame configuration and the mounting frame.

6. The elevating apparatus of claim 1, wherein the mounting frame includes, two mounting brackets;

slide members respectively attached to the two mounting brackets;

a motor-mount bar; and a motor attached to the motor-mount bar.

7. The elevating apparatus of claim 1, wherein the movable frame configuration is provided with at least one support member to be attached to the visual display.

8. The elevating apparatus of claim 1, further including a mounting panel attached to the mounting frame.

9. The elevating apparatus of claim 1, wherein the elevating apparatus has a front area where the display is to be located, and the threaded rod is positioned behind the front area, such that a portion of the threaded rod is disposed at a height equal to a height of a portion of the display in a horizontal plane.

10. The elevating apparatus of claim 1, further including a motor that drives the threaded rod so as to elevate the display to a desired height, and to lower the display.

* * * * *